US010538360B2

(12) United States Patent
Thompson

(10) Patent No.: US 10,538,360 B2
(45) Date of Patent: Jan. 21, 2020

(54) NESTABLE PALLET WITH RUNNERS

(71) Applicant: ORBIS Corporation, Oconomowoc, WI (US)

(72) Inventor: Benjamin Joel Thompson, Johnson Creek, WI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 15/885,962

(22) Filed: Feb. 1, 2018

(65) Prior Publication Data

US 2018/0229887 A1 Aug. 16, 2018

Related U.S. Application Data

(60) Provisional application No. 62/454,236, filed on Feb. 3, 2017.

(51) Int. Cl.
*B65D 19/00* (2006.01)

(52) U.S. Cl.
CPC ..... *B65D 19/0018* (2013.01); *B65D 2519/00034* (2013.01); *B65D 2519/00069* (2013.01); *B65D 2519/0094* (2013.01); *B65D 2519/00129* (2013.01); *B65D 2519/00268* (2013.01); *B65D 2519/00288* (2013.01); *B65D 2519/00308* (2013.01); *B65D 2519/00318* (2013.01); *B65D 2519/00442* (2013.01)

(58) Field of Classification Search
CPC .... B65D 2519/0094; B65D 2519/0096; B65D 2519/00935; B65D 2519/00955; B65D 2519/00965; B65D 2519/0097
USPC ..... 108/53.3, 53.1, 53.5, 57.25
See application file for complete search history.

(56) References Cited

U.S. PATENT DOCUMENTS 3,167,341 A * 1/1965 Higgins ..... B65D 19/0048 108/53.3
4,019,634 A * 4/1977 Bonnot ..... B65D 19/06 108/53.3
4,093,070 A 6/1978 Stahl
4,093,071 A 6/1978 Stahl et al.
4,211,327 A 7/1980 Stahl et al.
4,383,611 A 5/1983 Kreeger
(Continued)

FOREIGN PATENT DOCUMENTS

WO 2018144861 A1 8/2018

OTHER PUBLICATIONS

Korean Intellectual Property Office; International Search Report for PCT/US2018/016641; dated May 15, 2018 (3 pages).
(Continued)

*Primary Examiner* — Jose V Chen
(74) *Attorney, Agent, or Firm* — Greensfelder, Hemker & Gale, P.C.

(57) ABSTRACT

A nestable pallet having three rows of feet extending downward from a support surface is provided. In one aspect, the outer rows of feet are attached by runners at a bottom portion of each foot and the middle row of feet does not include runners. The support surface includes openings to accommodate the outer rows of feet with runners, and the middle row of feet of a like pallet. The absence of runners in the middle row and a corresponding larger opening, allows for greater support area in that portion of the pallet. The pallet can also include reinforcements extending perpendicular to the runners.

20 Claims, 13 Drawing Sheets

(56) References Cited

U.S. PATENT DOCUMENTS 4,905,833 A 3/1990 Kreeger et al.
5,413,052 A * 5/1995 Breezer ..... B65D 19/0012 108/56.1
5,606,921 A 3/1997 Elder et al.
5,860,369 A * 1/1999 John ..... B65D 19/0075 108/56.1
5,868,080 A * 2/1999 Wyler ..... B65D 19/0022 108/57.25
6,029,583 A * 2/2000 LeTrudet ..... B65D 19/0012 108/57.25
D446,900 S 8/2001 Koefelda et al.
6,289,823 B1 9/2001 Koefelda et al.
6,807,910 B2 * 10/2004 Apps ..... B65D 19/0012 108/57.25
7,320,405 B2 1/2008 Stahl
7,607,628 B2 * 10/2009 Elder ..... B65D 19/0036 108/53.3
7,690,315 B2 4/2010 Apps
7,819,068 B2 10/2010 Apps et al.
8,191,486 B2 6/2012 Apps et al.
8,230,793 B2 7/2012 Apps
8,448,583 B2 5/2013 Apps et al.
8,511,239 B2 * 8/2013 Lin ..... B65D 19/0038 108/53.1
8,967,056 B2 3/2015 Apps et al.
2001/0029874 A1 * 10/2001 Muirhead ..... B65D 19/0012 108/57.25
2002/0017225 A1 2/2002 Koefelda et al.
2004/0134390 A1 7/2004 Apps et al.
2004/0149180 A1 8/2004 Apps et al.
2004/0159267 A1 * 8/2004 Markling ..... B29C 49/20 108/57.25
2004/0216648 A1 * 11/2004 Apps ..... B65D 19/0012 108/57.25
2006/0075939 A1 * 4/2006 Shuert ..... B65D 19/0016 108/57.25
2006/0201401 A1 * 9/2006 Moore, Jr. ..... B65D 19/0095 108/57.25
2007/0181045 A1 8/2007 Smyers et al.
2008/0143514 A1 * 6/2008 Valentinsson ..... B65D 19/0014 340/539.1
2008/0202391 A1 * 8/2008 Pisano ..... B65D 19/0044 108/57.25
2010/0154685 A1 * 6/2010 Arinstein ..... B65D 19/0018 108/57.16
2010/0319589 A1 * 12/2010 Lin ..... B65D 19/004 108/57.28
2011/0179978 A1 * 7/2011 Schmitt ..... B29C 45/2628 108/53.3
2012/0132114 A1 * 5/2012 Krupka ..... B65D 19/0095 108/57.25
2012/0160734 A1 * 6/2012 Linares ..... B65D 19/0026 206/596
2012/0291678 A1 11/2012 Howland et al.
2012/0304898 A1 * 12/2012 Dubois ..... B65D 19/0063 108/57.25
2013/0032507 A1 2/2013 Du Toit et al.
2016/0264292 A1 * 9/2016 Schoening ..... G06Q 10/0833
2017/0081075 A1 3/2017 Bruce et al.
2017/0297765 A1 10/2017 Guerry et al.
2017/0341810 A1 * 11/2017 Banik ..... B65D 21/02

OTHER PUBLICATIONS

Korean Intellectual Property Office; Written Opinion of the International Searching Authority; dated May 15, 2018 (9 pages).

* cited by examiner

NESTABLE PALLET WITH RUNNERS

CROSS-REFERENCE TO RELATED APPLICATIONS

The present invention claims the benefit of U.S. Provisional Patent Application No. 62/454,236 filed Feb. 3, 2017, the contents of which are incorporated herein by reference.

FEDERALLY SPONSORED RESEARCH OR DEVELOPMENT

N/A

FIELD OF THE INVENTION

The present invention is generally related to nestable pallets having runners connecting the feet of the pallet.

DESCRIPTION OF THE PRIOR ART

Typically pallets fall into two categories—nestable (which are usually plastic) and stackable. One benefit of nestable pallets is that—when nested—they efficiently condense to a small space. This ability to nest facilitates return shipping of empty pallets. The tradeoff for this is less strength and conveyability of the pallet. In contrast to nestable pallets, stringers incorporated into most stackable designs give the pallet significantly improved rigidity, particularly when supported by the tines of a forklift, and improved conveyability. Nestable pallets, however, must rely solely on the deck to hold shape, and support boards to allow for use on conveyors.

One solution to increase strength (at least in one direction) and conveyability of the nestable pallet is to provide runners connecting feet of the pallet (such as that shown in EP 2067708A1). However, such nestable pallets included at least three rows of feet and three corresponding runners connecting the feet in each respective row. To properly nest with other like pallets, each pallet required openings in the upper support surface to accommodate all the rows of runners. The large openings needed to accommodate the runners reduced the usable space on the upper support surface. They also compromised strength across the width of the pallet.

The present invention provides nestable pallets with improved strength and nestable pallets with more support surface area in the central portion of the support surface or deck.

SUMMARY OF THE INVENTION

The present invention provides nestable pallets with improved strength and deflection properties, and nestable pallets with increased surface area on the upper support surface and strength through the center of the pallet.

The pallets with increased surface area include three or more rows of feet extending downward from the support surface. Unlike prior nestable pallets, the nestable pallets having increased surface area only have runners connecting the outer rows of feet, and do not include runners connecting the inner or middle row (or rows) of feet. Accordingly, openings in the upper support surface to accommodate the runners of a like pallet are not required for the inner row (or rows), allowing that area to be used for supporting goods or other items on the nestable pallet.

In accordance with one aspect of the invention, a nestable pallet with increased support surface space is provided. The nestable pallet comprises a generally rectangular support surface having a first row of feet extending downward from proximate a first side of the support surface. The feet in the first row of feet are connected by runners at a lower portion of each of the first row of feet. An opening is provided proximate the first side of the support surface for allowing nesting of the first row of feet and runners of a like pallet. The pallet includes a second row of feet extending downward from proximate a second side of the support surface. Similar to the first row of feet, the feet in the second row of feet are connected by runners at a lower portion of each of the second row of feet. An opening proximate the second side of the support surface is provided for allowing nesting of the second row of feet and runners of the like pallet. The pallet further includes a third row of feet extending downward from proximate a middle portion of the support surface and a plurality of openings proximate the middle portion of the support surface corresponding with each of the feet in the third row of feet. The feet in the third row of feet are not connected to each other by runners. Accordingly, the support surface includes a first support area directly between a first foot of the third row of feet and a second foot of the third row of feet. This effectively prevents the pallet from nesting with a pallet having three runners (i.e., a runner connecting the middle feet in addition to the feet proximate the sides of the pallet). That is, this support area (between the openings) would have to be open if runners were connecting all of the rows of feet.

The pallet can further include a second support area directly between the second foot of the third row of feet and a third foot of the third row of feet. Similar areas can be provided if the pallet includes more than three feet in the middle row.

Additionally, each of the openings in the middle portion of the support surface can include internal support structure.

In accordance with an aspect of the invention, a pallet having additional support surface is provided. The pallet includes a generally rectangular support surface and a first row of feet extending downward from proximate a first side of the support surface. Each of the feet in the first row of feet are connected by a first set of runners at a lower portion of each of the feet. An opening is formed proximate the first side of the support surface. The opening is configured for allowing nesting of a first row of feet and runners of a like pallet. The pallet includes a second row of feet extending downward from proximate a second side of the support surface. Similar to the first row of feet, each of the feet in the second row of feet are connected by a second set of runners at a lower portion of each of the feet. An opening proximate the second side of the support surface is provided for allowing nesting of a second row of feet and runners of the like pallet. The pallet also includes a third row of feet extending downward from proximate a middle portion of the support surface and a plurality of openings proximate the middle portion of the support surface, each of the plurality of openings corresponding with one of the feet in the third row of feet. The support surface includes a first support area directly between a first opening of the plurality of openings for a first foot of the third row of feet and a second opening of the plurality of openings for a second foot of the third row of feet. In view of the support area between the first two openings in the third row, the pallet cannot be configured to stack with any pallets having runners in the middle row. However, it has this additional area for use in supporting goods or other items placed on the pallet.

Additionally, the pallet includes a second support area directly between the second opening of the plurality of openings for the second foot of the third row of feet and a third opening of the plurality of openings for a third foot of the third row of feet. Again, this prohibits stacking with a pallet having runners connecting feet in the middle row.

Each foot in the pallet can include an internal support structure extending upward in the interior of the respective opening. The internal support structure of the first foot can include a first rib extending from a central portion of the support structure to a periphery of the first opening. Similarly, the internal support structure of the first foot can include a second rib extending from the central portion of the support structure to the periphery of the first opening.

The nestable pallet can further include a plurality of reinforcements. The reinforcements can extend perpendicular to the first and second sets of runners. Alternatively, reinforcements can run parallel to the runners. The reinforcements can be steel tubes or bars. The steel tubes can have a square cross-sectional shape, or other suitable shape.

In accordance with an aspect of the invention, another nestable pallet is provided. The pallet includes a rectangular support surface, a first foot and a second foot extending downward from the support surface in a first row and a first runner connecting a bottom portion of each of the foot and the second foot. A first opening is provided in the support surface over the first foot, second foot and first runner. The pallet also includes a third foot and a fourth foot extending downward from the support surface in a second row and a second runner connecting a bottom portion of each of the third foot and the fourth foot. A second opening is provided over the third foot, fourth foot and second runner. The pallet further includes a fifth foot and a sixth foot extending downward from the support surface in a third row, a third opening over the fifth foot and a fourth opening over the sixth foot. The support surface includes a portion directly between the fifth foot and the sixth foot.

The pallet can also include internal supports, ribs or reinforcements as described herein.

In accordance with another aspect of the invention, a pallet with three rows of feet connected by runners is provided. The pallet includes a generally rectangular support surface and a first row of feet extending downward from proximate a first side of the support surface. The feet in the first row of feet are connected by a first set of runners at a lower portion of each of the first row of feet. The pallet also includes an opening proximate the first side of the support surface for allowing nesting of a first row of feet and runners of a like pallet. The pallet further includes a second row of feet extending downward from proximate a middle portion of the support surface. The feet of the second row of feet are also connected by a second set of runners at a lower portion of each of the second row of feet. The pallet also includes an opening proximate the middle portion of the support surface for allowing nesting of a second row of feet and runners of the like pallet. The pallet further includes a third row of feet extending downward from proximate a second side of the support surface. The feet of the third row of feet are also connected by a third set of runners at a lower portion of each of the third row of feet. The pallet also includes an opening proximate the second side of the support surface for allowing nesting of a third row of feet and runners of the like pallet. The pallet further includes a reinforcement extending from the first side to the second side. The reinforcement is perpendicular to the first, second and third sets of runners.

Preferably, any of the pallets described are formed from plastic or other suitable material.

Further aspects of the invention are shown in the Figures and described herein.

BRIEF DESCRIPTION OF THE DRAWINGS

To understand the present invention, it will now be described by way of example, with reference to the accompanying drawings in which.

DETAILED DESCRIPTION

Figure 1:
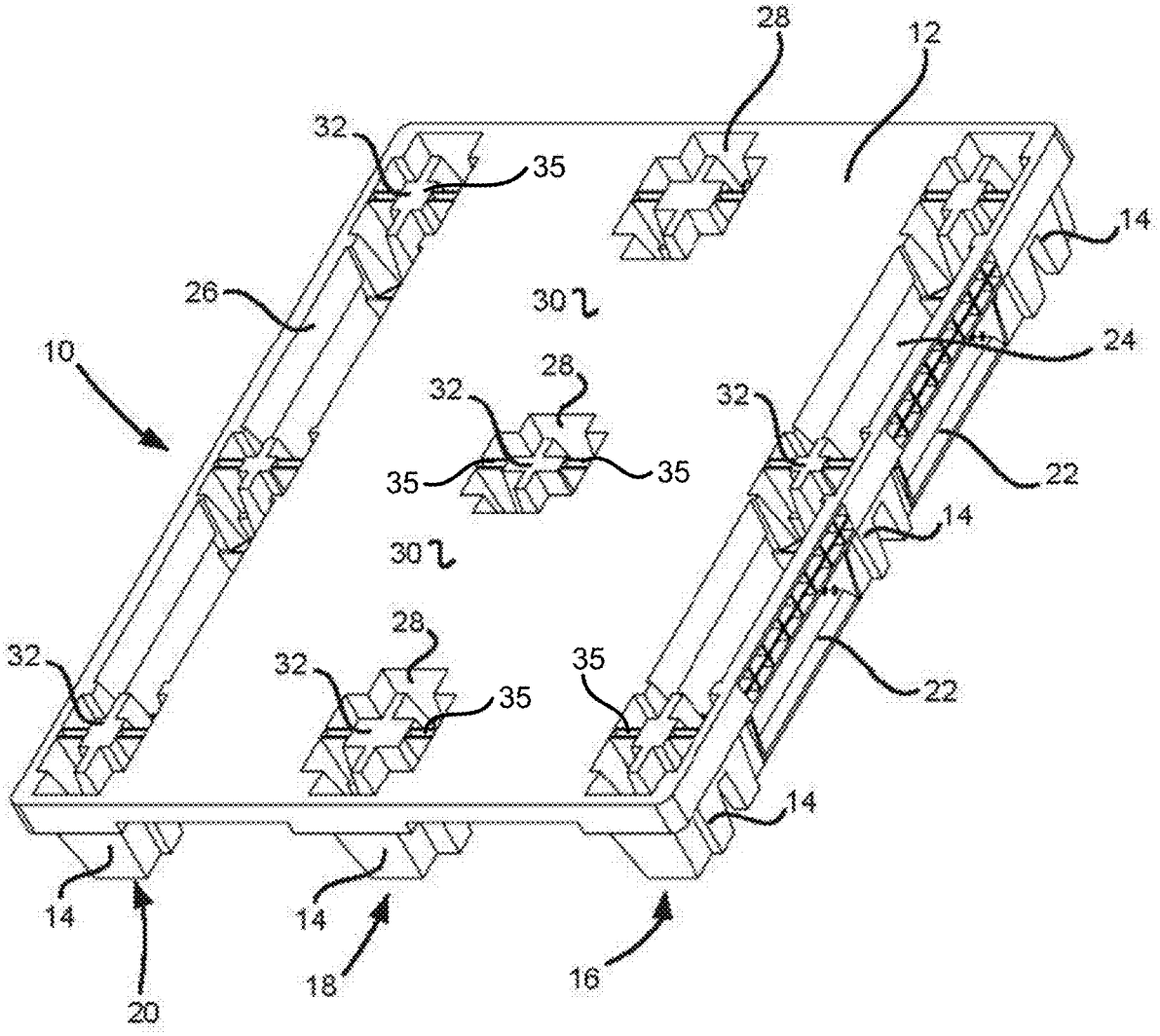
FIG. 1 is perspective view of a nestable pallet in accordance with the present invention.
Figure 2:
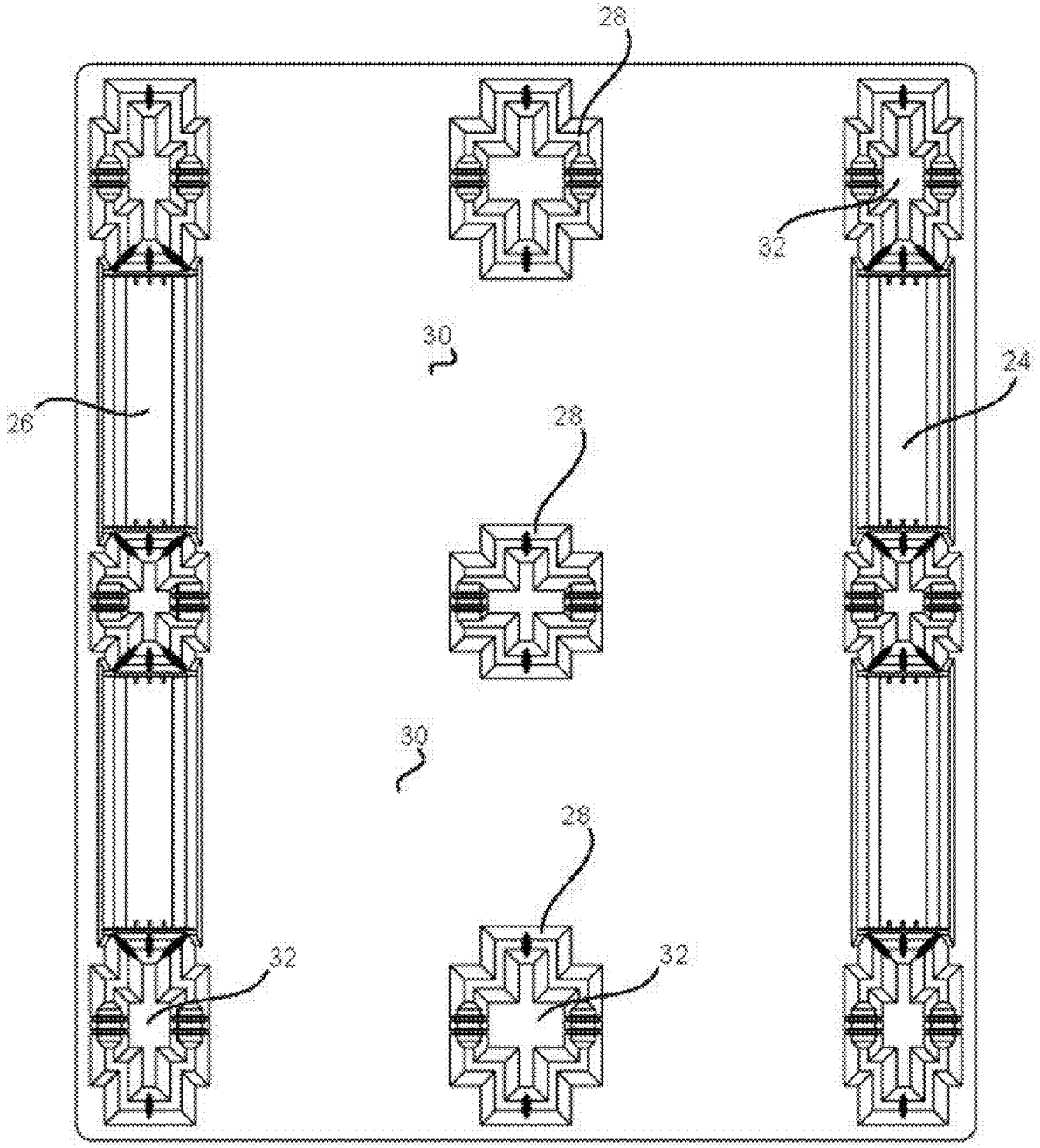
FIG. 2 is a top plan view of the nestable pallet of FIG. 1.
Figure 3:
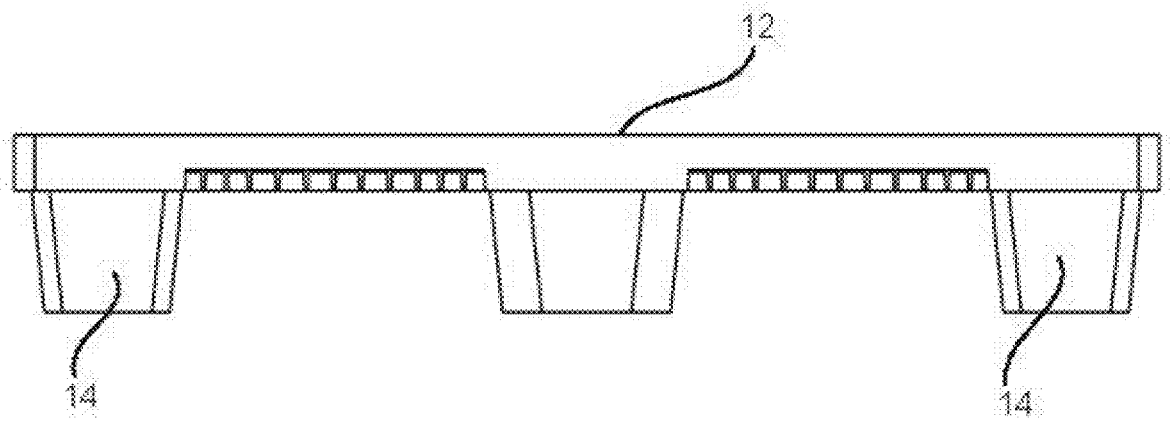
FIG. 3 is an end plan view of a first end of the nestable pallet of FIG. 1.
Figure 4:
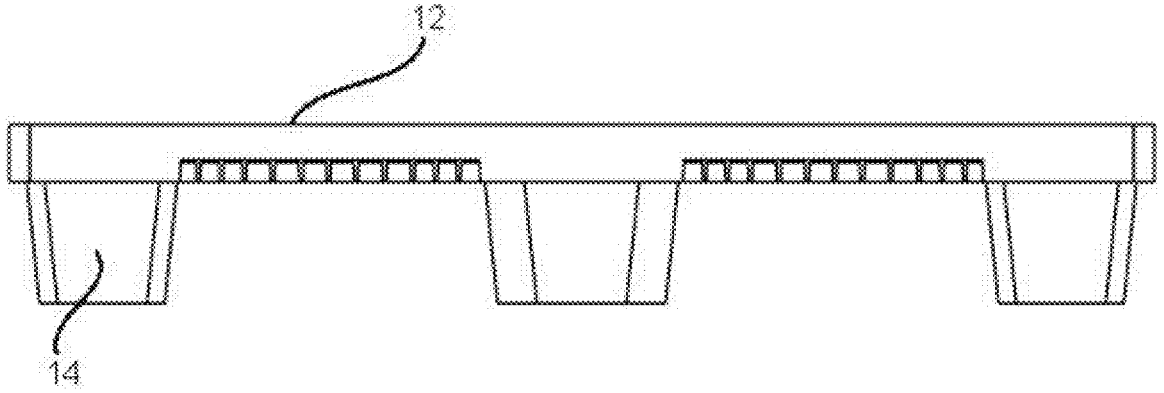
FIG. 4 is an end plan view of a second end of the nestable pallet of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 5:
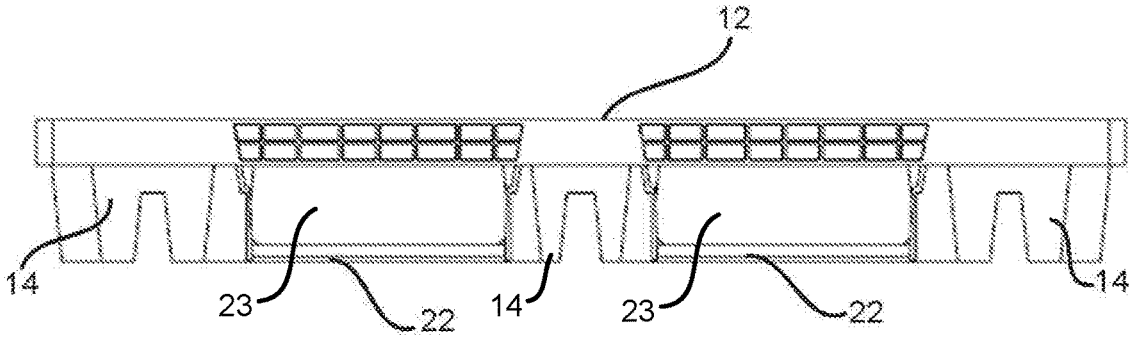
FIG. 5 is a side plan view of a first side of the nestable pallet of FIG. 1
Figure 6:
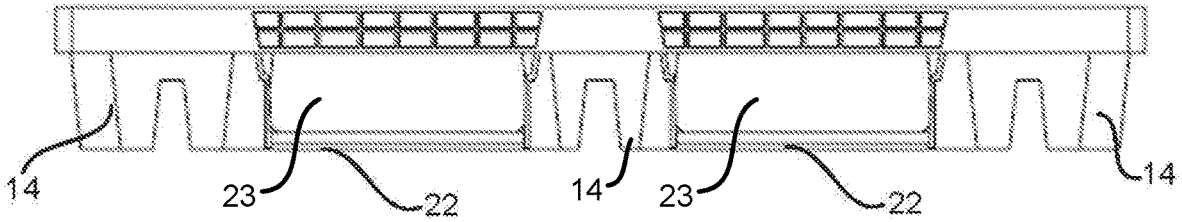
FIG. 6 is a side plan view of a second side of the nestable pallet of FIG. 1.

Referring to FIGS. 1-8, a nestable pallet 10 in accord with one aspect of the present invention is shown. The nestable pallet 10 includes a generally rectangular support surface 12 having a first side, a second side, a first end and a second end. A plurality of feet 14 extend downward from the support surface 12. In this embodiment, the feet 14 are positioned in three rows, a first outer row 16, a middle row 18 and a second outer row 20. Each row 16, 18 and 20 includes three feet 14. The feet 14 in the outer two rows 16 and 20 of the pallet 10 are shown connected by runners 22. As shown in FIGS. 5 and 6, the runners 22, feet 14 and support surface 12 collectively define openings 23 in the side of the pallet 10.

As shown in FIG. 1, each of the outer rows 16, 20 of feet 14 that are connected by runners 22, have corresponding openings 24, 26 on the upper support surface 12. As is evident in the Figures, the openings 24, 26 for these outer rows 16, 20 extend almost the entire length of the pallet 10 to accommodate the runners 22. The openings are used to accommodate feet/runners from a like nestable pallet that is placed on the pallet 10 (i.e., to nest with and reduce the volume of such pallets when shipped empty).

In contrast to the outer rows 16, 20, the feet in the middle row are not connected by runners. Accordingly, the support surface 12 in the middle portion of the pallet 10 only requires openings 28 sufficiently sized to accommodate the feet 14. This allows for the support surface 12 to include areas 30 directly between the feet 14 openings 28 in the middle row 18 for supporting goods or other items placed on the pallet 10. This effectively increases the support surface area over similar dimensioned pallets having three rows of feet all of which are connected by runners. The area directly between the feet 14 openings 28 in the middle row 18 does not have to be completely solid. That is, the area can be or include a lattice like structure, or other similar structure having other openings, so long as some portion of the area is generally level with the remaining support surface of the pallet and useable as a support surface. Having a support surface between the openings would not allow such a pallet to nest with a pallet having three rows of feet where each row is connected by runners.

The openings 24, 26 and 28 allow for the pallet 10 to nest with a like pallet. The "like" pallet can be identical to the instant pallet 10, or one that is sufficiently similar so that it fits in the openings of the pallet 10 in a nesting relationship.

The openings 28 (or parts of outer row 16, 20 openings 24, 26) for the feet 14, can be completely hollow, or the feet 14 can include internal support structure 32 for providing additional strength extending upward in the opening. In this latter instance (as shown in the Figures), the openings can be formed to include multiple sections.

Unlike prior nestable pallets having runners 22, the pallet 10 shown in FIGS. 1-8 does not include runners connecting the middle row 18 of feet 14. Because the pallets are designed to nest with similar like pallets, the pallets must have openings in the support surface to accommodate the runners. Removing runners from the middle row 18 allows the pallet 10 to have more surface area on the support surface 12.

Figure 7:
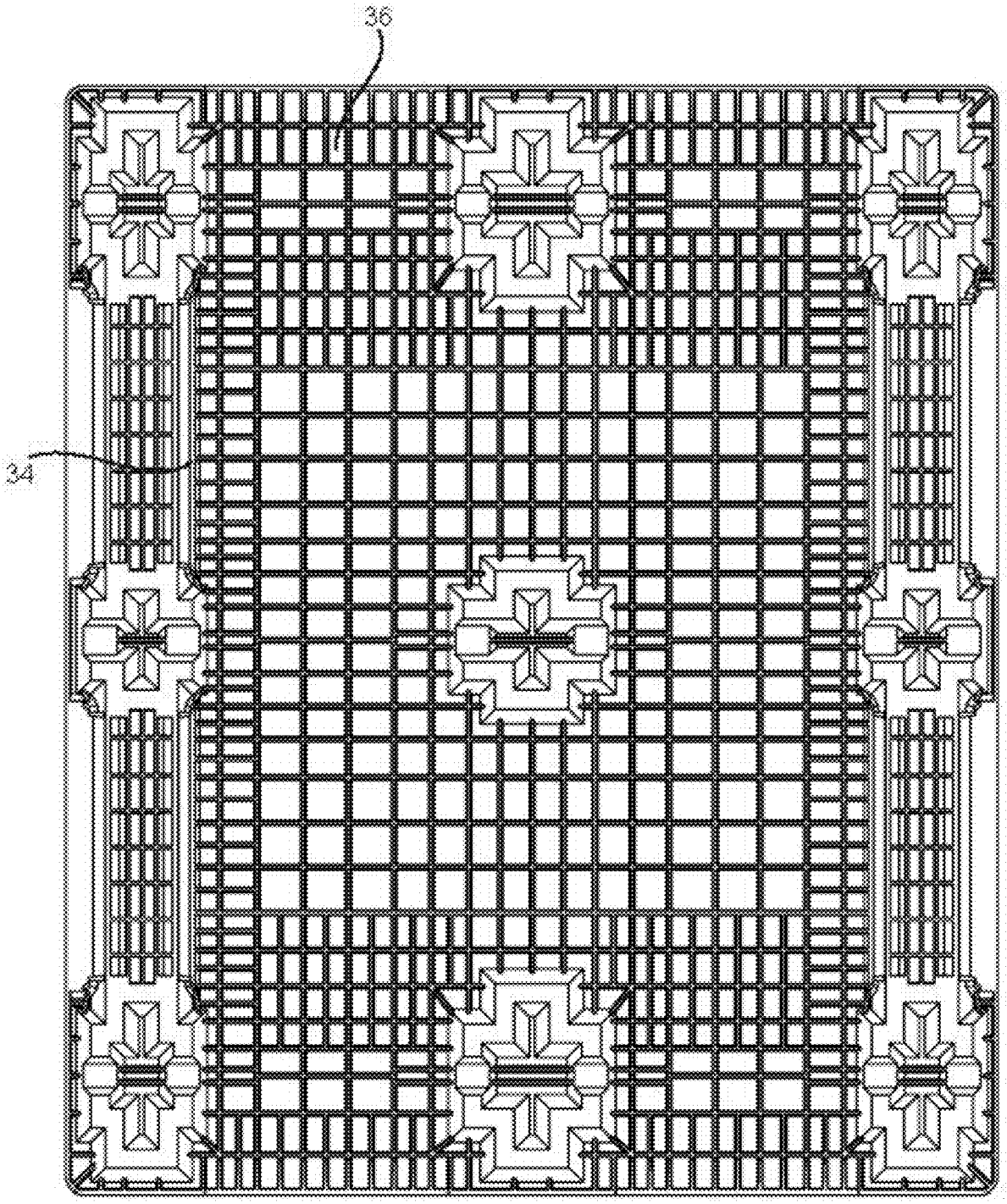
FIG. 7 is a bottom plan view of the nestable pallet of FIG. 1.
Figure 8:
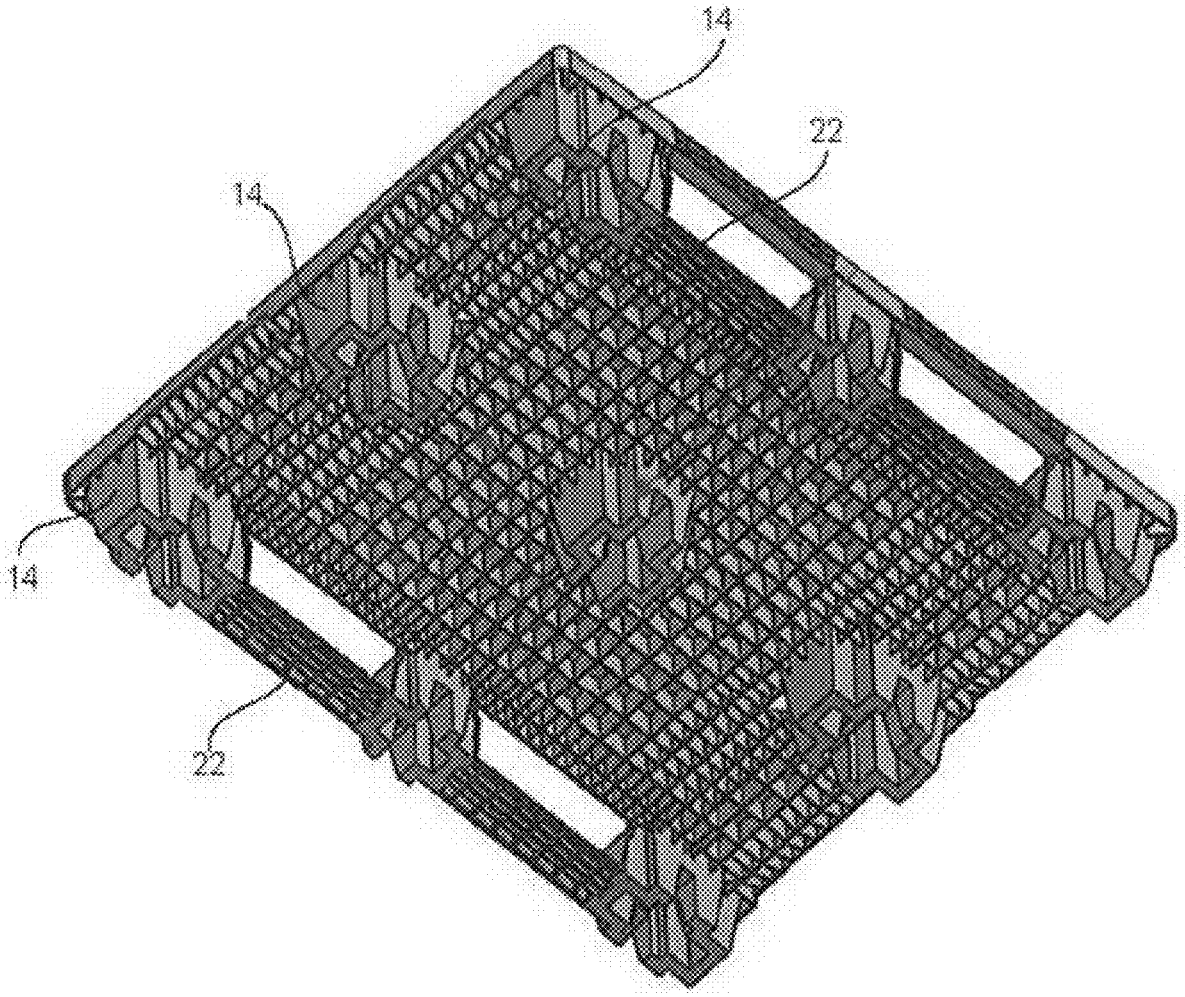
FIG. 8 is a bottom perspective view of the nestable pallet of FIG. 1
Figure 9:
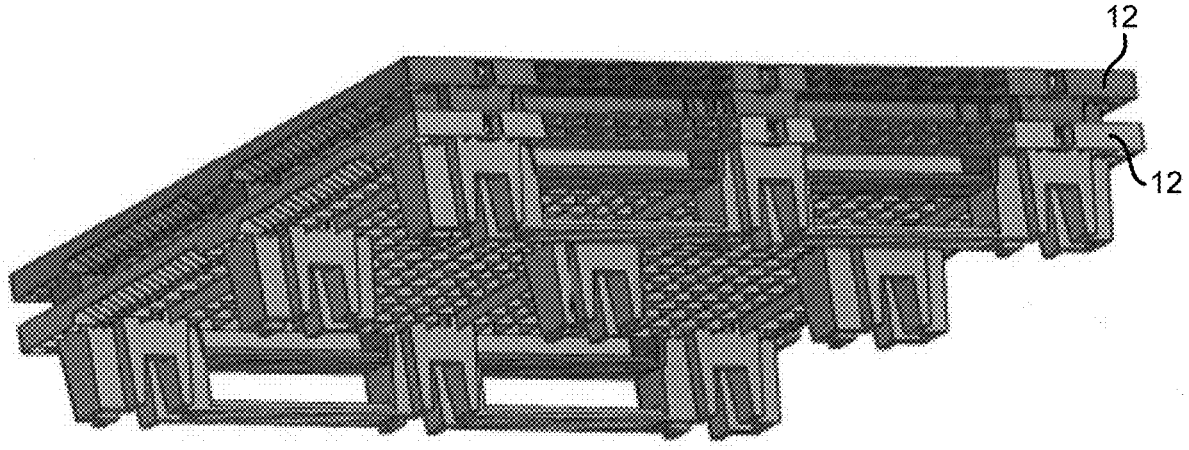
FIG. 9 is a perspective view of two nestable pallets of the present invention nested together.

As shown in FIG. 7, the bottom 34 of the support surface 12 can include a plurality of downwardly extending ribs 36 for increased strength of the pallet 10.

In the pallet of FIGS. 1-9, the internal support structure 32 includes ribs 35 that extend side-to-side (of the opening) in a width direction (i.e., perpendicular to the runners 22). That is, the ribs 35 extend from a portion of the internal support structure located in a central portion of the opening to a periphery of the opening. These ribs 35 provide additional strength to inhibit or stop deck deflection of the pallet 10.

Figure 10:
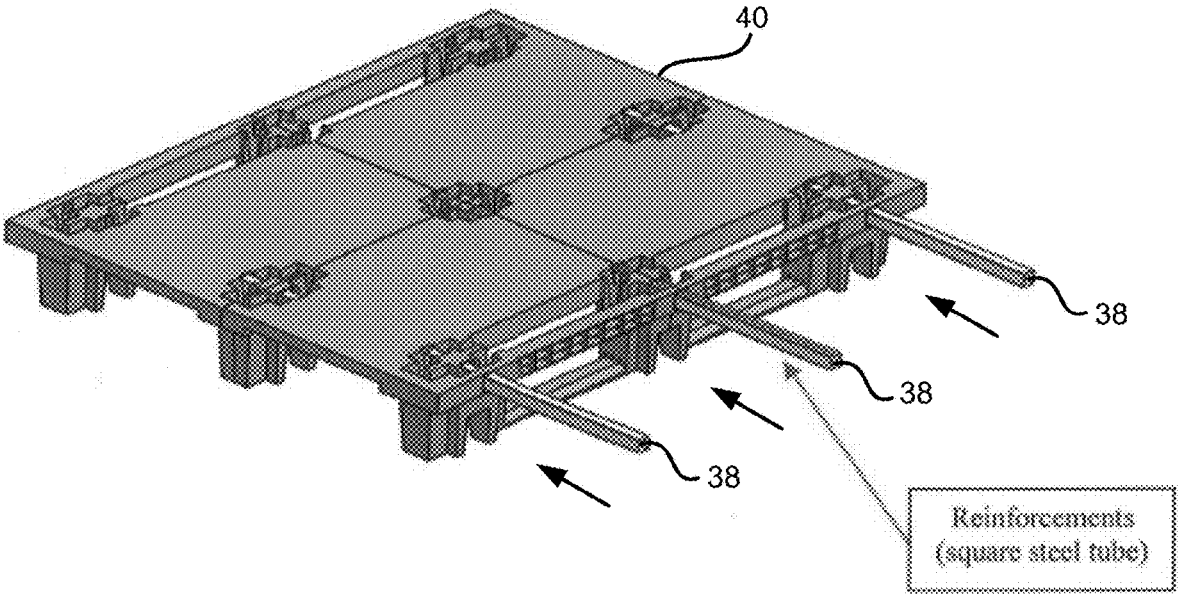
FIG. 10 is a perspective view of a nestable pallet of FIG. 1 with reinforcement bars being inserted into the pallet.
Figure 11:
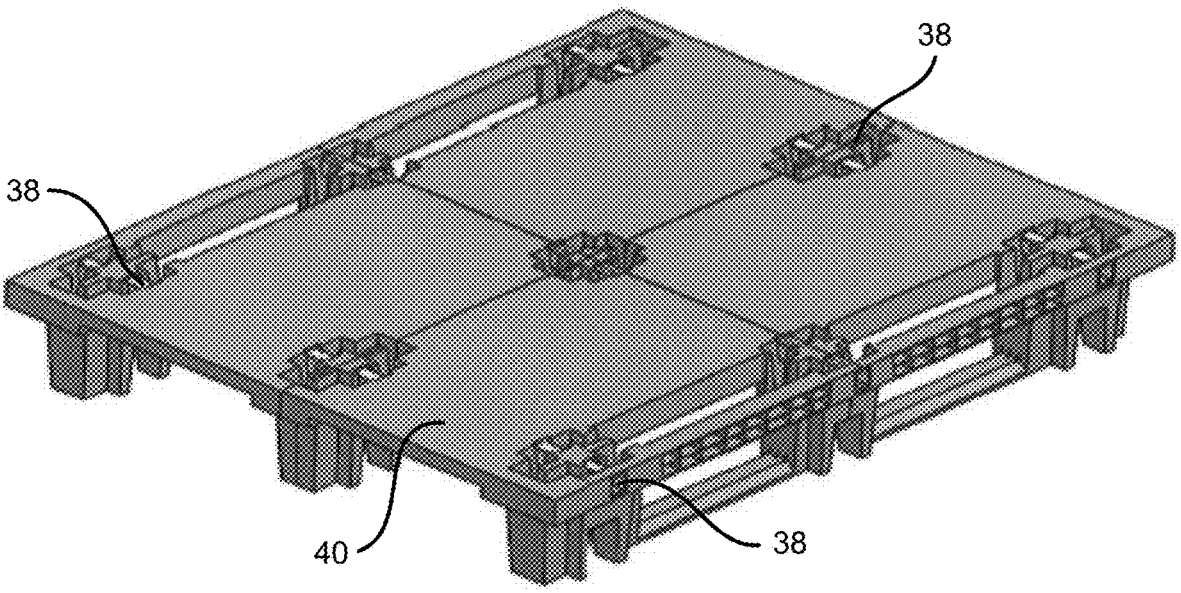
FIG. 11 is a perspective view of the nestable pallet of FIG. 10 with the reinforcement bars fully inserted.
Figure 12:
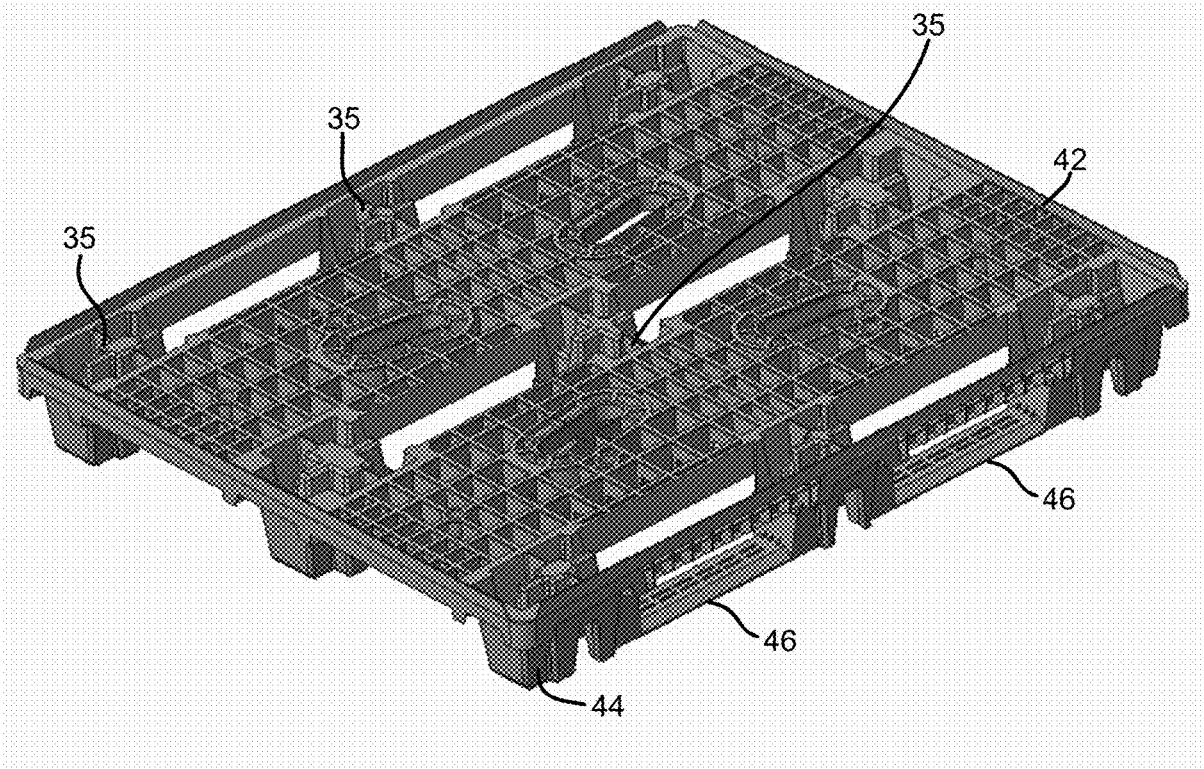
FIG. 12 is an elevated perspective view of a nestable pallet in accordance with another aspect of the present invention.
Figure 13:
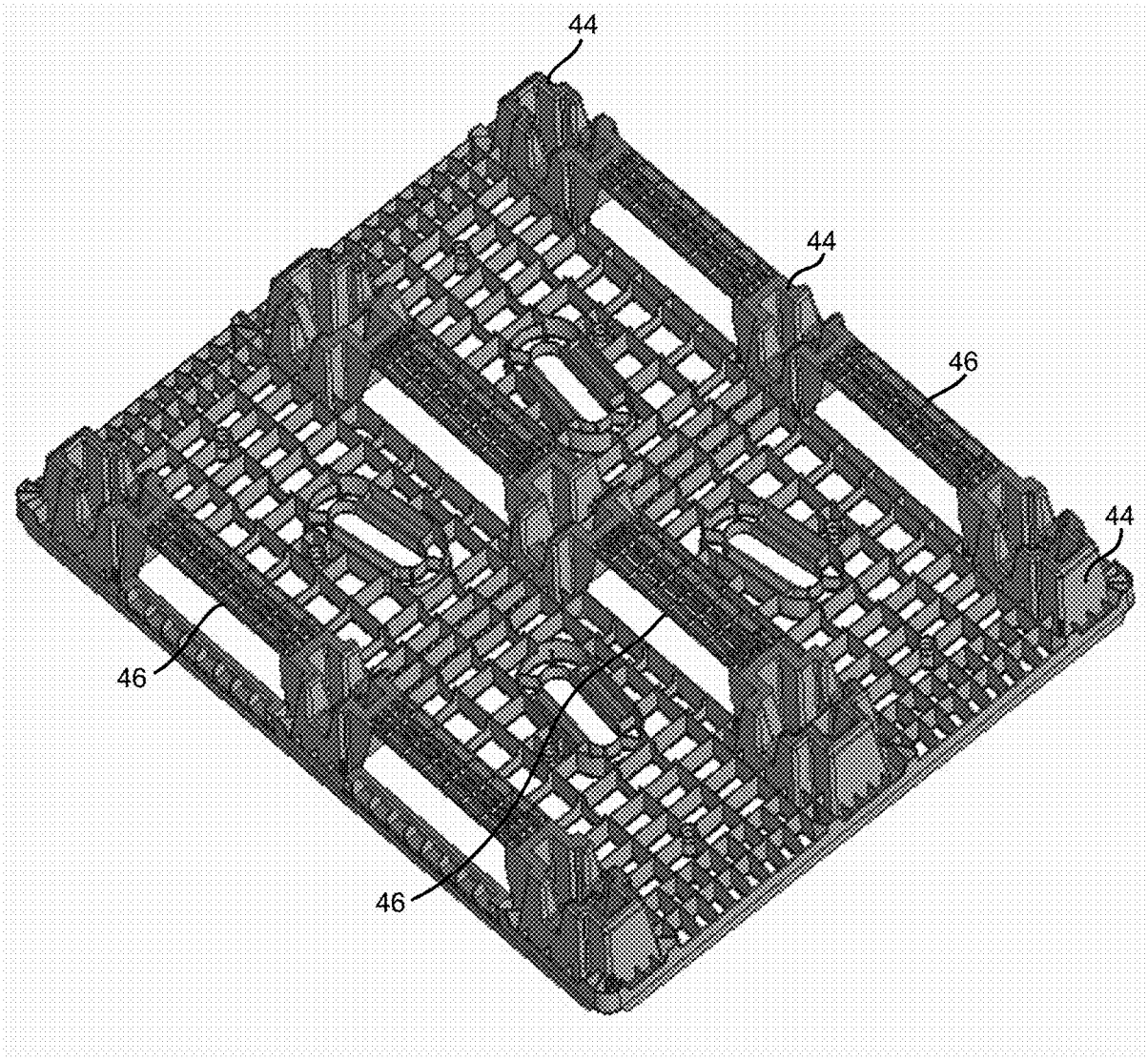
FIG. 13 is a bottom perspective view of the nestable pallet of FIG. 12.
Figure 14:
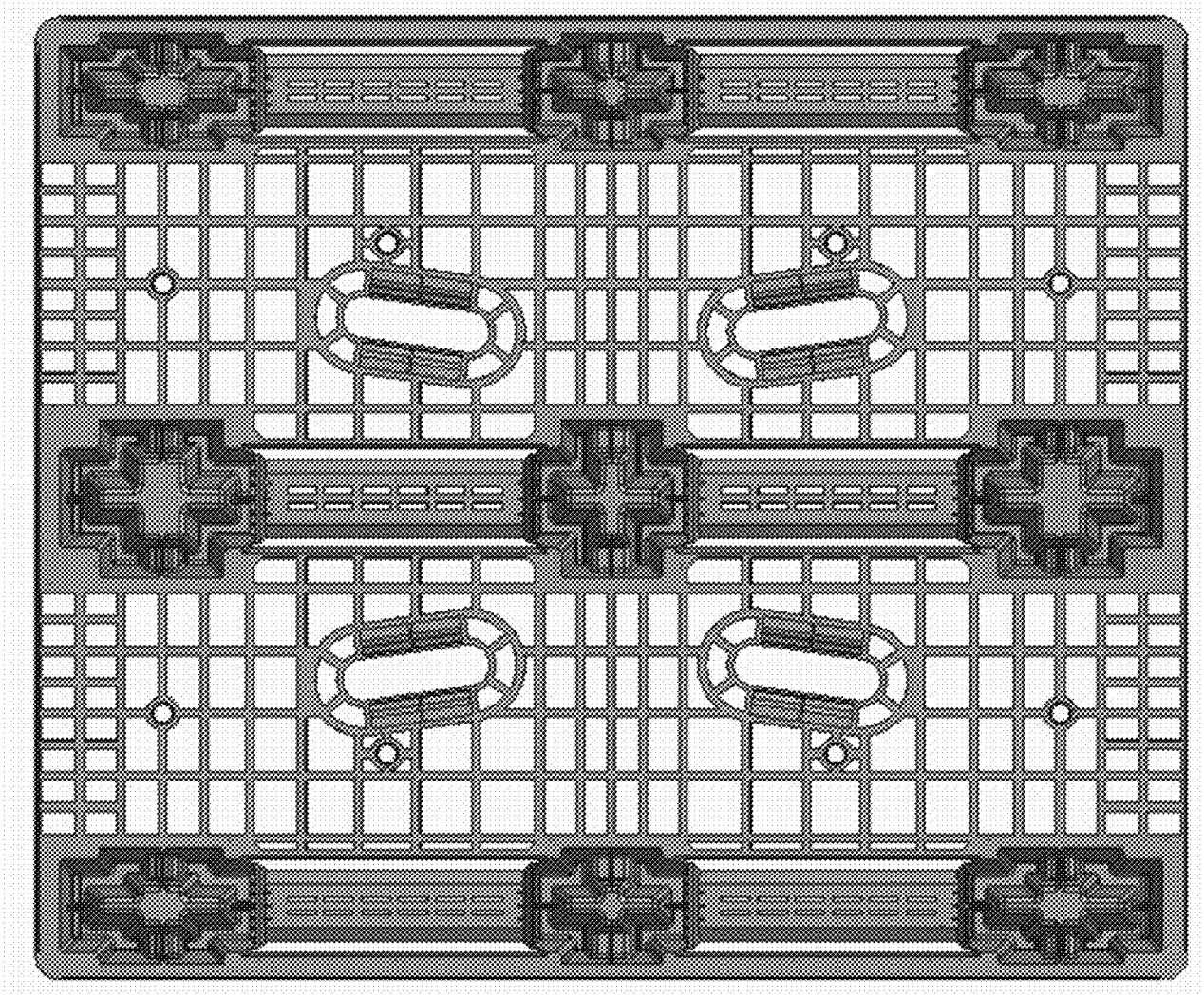
FIG. 14 is a top plan view of the nestable pallet of FIG. 12.
Figure 15:
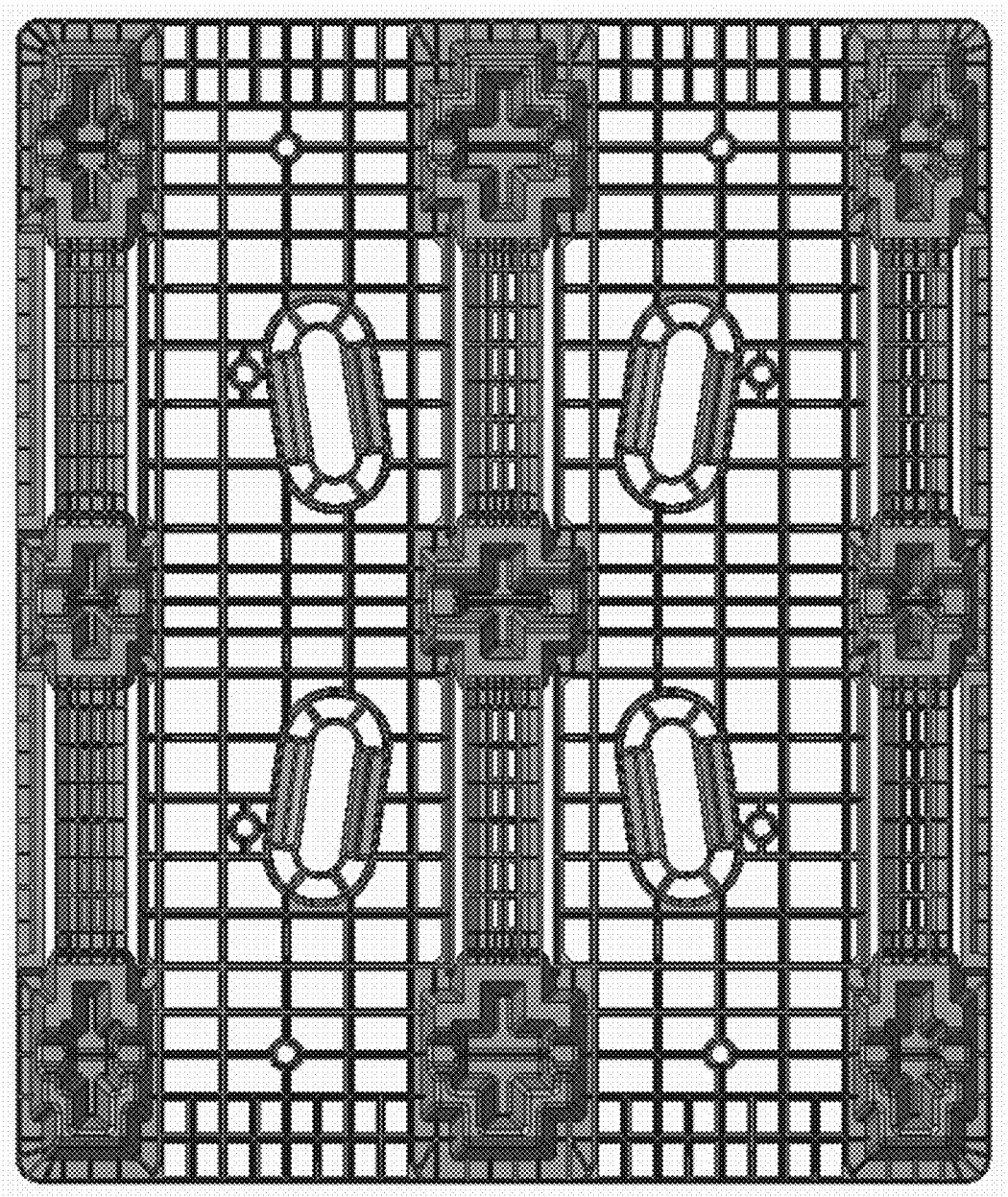
FIG. 15 is a bottom plan view of the nestable pallet of FIG. 12.

FIGS. 10 and 11 provide a pallet 40 where the internal structure 32 does not include ribs 35. Rather, the pallet 40 includes reinforcements 38 inserted into the pallet to provide strength against deck deflections.

FIG. 10 shows the reinforcements 38 being inserted into openings on a side of a pallet 40. FIG. 11 shows the pallet 10 with the reinforcements 38 fully in place. The reinforcements 38 shown are steel tubes (or possibly solid bars) having a square cross-sectional shape. However, other shapes and materials can be used. The reinforcements 38 are shown going across the width of the pallet 40 (i.e., perpendicular to the runners 22). The pallet can be configured to also receive reinforcements across the length of the pallet (i.e., parallel to the runners 22).

FIGS. 12-15 show another aspect of the present invention. A pallet 42 is shown having three rows of feet 44 where each row includes runners 46 connecting the feet 44 in the row. Similar to the pallet 10 of FIGS. 1-9, the pallet 42 of FIGS. 12-15 includes feet 44 having internal structures 48 with side-to-side extending ribs 50. As discussed, the ribs 50 provide additional strength in this direction to inhibit deck deflection. Alternatively, the pallet can be configured to receive reinforcements 38 perpendicular to the runners as described with respect to FIGS. 10 and 11.

The pallets shown are preferably formed from a molded plastic, or other similar material.

Many modifications and variations of the present invention are possible in light of the above teachings. It is, therefore, to be understood within the scope of the appended claims the invention may be protected otherwise than as specifically described.

I claim:

1. A nestable pallet comprising:

a generally rectangular horizontal support surface;

a first row of feet extending downward from proximate a first side of the horizontal support surface, the first row of feet connected by a first set of flat runners at a lower portion of each of the first row of feet, wherein the first set of runners, the horizontal support surface and the first row of feet define a first set of vertical openings between the feet of the first row of feet immediately above the first set of runners, the horizontal support surface having a first side wall along the first side wherein the first side wall includes a plurality of ribs extending outward from the first side wall between the feet in the first row of feet;

an opening in the horizontal support surface proximate the first side of the horizontal support surface for allowing nesting of a first row of feet and runners of a like pallet;

a second row of feet extending downward from proximate a second side of the horizontal support surface, the second row of feet connected by a second set of flat runners at a lower portion of each of the second row of feet, wherein the second set of runners, the horizontal support surface and the second row of feet defining a second set of vertical openings between the feet of the second row of feet immediately above the second set of runners;

an opening in the horizontal support surface proximate the second side of the horizontal support surface for allowing nesting of a second row of feet and runners of the like pallet;

a third row of feet extending downward from proximate a middle portion of the horizontal support surface and a plurality of horizontal openings proximate the middle portion of the support surface, each of the plurality of openings corresponding with one of the feet in the third row of feet, wherein the horizontal support surface includes a first support area directly between a first opening of the plurality of openings for a first foot of the third row of feet and a second opening of the plurality of openings for a second foot of the third row of feet.

2. The nestable pallet of claim 1 further including a second support area directly between the second opening of the plurality of openings for the second foot of the third row of feet and a third opening of the plurality of openings for a third foot of the third row of feet.

3. The nestable pallet of claim 1 wherein each foot includes internal support structure extending upward in the interior of the respective opening of the plurality of openings in the middle portion of the support surface.

4. The nestable pallet of claim 3 wherein the internal support structure of the first foot includes a first rib extending from a central portion of the support structure to a periphery of the first opening.

5. The nestable pallet of claim 4 wherein the internal support structure of the first foot includes a second rib extending from the central portion of the support structure to the periphery of the first opening.

6. The nestable pallet of claim 1 further comprising a reinforcement extending perpendicular to the first and second sets of runners.

7. The nestable pallet of claim 6 further comprising a plurality of reinforcements extending perpendicular to the first and second sets of runners.

8. The nestable pallet of claim 7 wherein the reinforcements are steel tubes.

9. The nestable pallet of claim 8 wherein the steel tubes have a square cross-sectional shape.

10. The nestable pallet of claim 1 further comprising a plurality of reinforcements extending parallel to the first and second sets of runners.

11. The nestable pallet of claim 1 wherein the pallet is formed from plastic.

12. A nestable pallet comprising:

a rectangular horizontal support surface;

a first foot and a second foot extending downward from the support surface in a first row, a first runner connecting a bottom portion of each of the first foot and the second foot, a first horizontal opening in the horizontal support surface over the first foot, second foot and first runner, and a first vertical opening defined by the horizontal support surface, the first foot, the second foot and the first runner, the horizontal support surface having a first side wall along a first side of the support surface, the first side wall having a plurality of ribs extending outward between the first foot and the second foot;

a third foot and a fourth foot extending downward from the horizontal support surface in a second row, a second runner connecting a bottom portion of each of the third foot and the fourth foot, a second horizontal opening over the third foot, fourth foot and second runner, and a second vertical opening defined by the third foot, fourth foot and the second runner;

a fifth foot and a sixth foot extending downward from the support surface in a third row, a third horizontal opening over the fifth foot and a fourth horizontal opening over the sixth foot, wherein the support surface includes a portion directly between the fifth foot and the sixth foot.

13. The nestable pallet of claim 12 wherein the fifth foot and sixth foot are in a middle portion of the support surface.

14. The nestable pallet of claim 12 wherein the fifth foot includes an internal support structure extending upward from a bottom portion of the fifth foot.

15. The nestable pallet of claim 14 wherein the internal support structure includes a first rib extending in a first direction to a periphery of the third opening.

16. The nestable pallet of claim 15 wherein the internal support structure includes a second rib extending in a second direction different than the first direction to the periphery of the third opening.

17. The nestable pallet of claim 12 further comprising a seventh foot in the third row and a fifth opening over the seventh, wherein the support surface includes a portion directly between the sixth foot and the seventh foot.

18. The nestable pallet of claim 12 further comprising a reinforcement extending from a first side of the support surface to a second side of the support surface.

19. The nestable pallet of claim 18 wherein the reinforcement is a steel tube.

20. A nestable pallet comprising:

a generally rectangular horizontal support surface;

a first row of feet extending downward from proximate a first side of the horizontal support surface, the first row of feet connected by a first set of flat runners at a lower portion of each of the first row of feet, wherein the first set of runners, the support surface and the first row of feet define a first set of vertical openings between the feet of the first row of feet, the horizontal support surface having a first side wall along the first side wherein the first side wall includes a plurality of ribs extending outward from the first side wall between the feet in the first row of feet;

an opening in the horizontal support surface proximate the first side of the horizontal support surface for allowing nesting of a first row of feet and runners of a like pallet;

a second row of feet extending downward from proximate a middle portion of the horizontal support surface, the second row of feet connected by a second set of flat runners at a lower portion of each of the second row of feet, the second set of runners and second row of feet defining a second set of vertical openings between the feet of the second row of feet;

an opening in the horizontal support surface proximate the middle portion of the horizontal support surface for allowing nesting of a second row of feet and runners of the like pallet;

a third row of feet extending downward from proximate a second side of the horizontal support surface, the third row of feet connected by a third set of flat runners at a lower portion of each of the third row of feet, the third set of runners and third row of feet defining a third set of vertical openings between the feet of the third row of feet;

an opening in the horizontal support surface proximate the second side of the horizontal support surface for allowing nesting of a third row of feet and runners of the like pallet; and, a reinforcement bar extending from the first side of the horizontal support s surface to the second side of the horizontal support s surface wherein the reinforcement bar is perpendicular to the first, second and third sets of runners.

* * * * *